US008516703B1

(12) United States Patent
Scarcella

(10) Patent No.: US 8,516,703 B1
(45) Date of Patent: Aug. 27, 2013

(54) KERFLESS AND BRACELESS METAL MUSICAL INSTRUMENTS AND METHOD

(76) Inventor: Gina Gale Scarcella, Raleigh, NC (US)

( * ) Notice: Subject to any disclaimer, the term of this patent is extended or adjusted under 35 U.S.C. 154(b) by 459 days.

(21) Appl. No.: 12/793,557

(22) Filed: Jun. 3, 2010

Related U.S. Application Data

(60) Provisional application No. 61/218,689, filed on Jun. 19, 2009.

(51) Int. Cl.
*G10D 1/08* (2006.01)

(52) U.S. Cl.
USPC ..... 29/896.22; 84/267; 84/291; 84/292; 156/153

(58) Field of Classification Search
USPC ..... 29/896.22; 84/291, 292, 267; 156/153; 984/107
See application file for complete search history.

(56) References Cited

U.S. PATENT DOCUMENTS

| | | | | |
|---|---|---|---|---|
| 3,722,345 | A | 3/1973 | Dopera | |
| 4,103,583 | A | 8/1978 | Takabayashi | |
| 4,178,827 | A | 12/1979 | Mallory | |
| 5,461,958 | A * | 10/1995 | Dresdner et al. | 84/267 |
| 6,233,825 | B1 * | 5/2001 | DeGroot | 29/896.22 |
| 6,605,766 | B2 | 8/2003 | Teel | |
| 7,525,030 | B2 * | 4/2009 | Clark | 84/290 |
| 8,207,432 | B2 * | 6/2012 | Fodera | 84/267 |
| 2005/0211052 | A1 | 9/2005 | Gigliotti | |
| 2008/0202309 | A1 | 8/2008 | Wiswell | |

* cited by examiner

*Primary Examiner* — Alexander P Taousakis
(74) *Attorney, Agent, or Firm* — QuickPatents; Kevin Prince

(57) ABSTRACT

A method of manufacturing a musical instrument using relatively thin metal sheet materials is disclosed. A metallic back plate is provided that has a peripheral edge. At least one metallic side plate with a peripheral edge is provided. Each side plate may be bent to conform to the shape of at least a portion of the peripheral edge of the back plate. A neck block and a tail piece may each be fixed to the inside surface of the back plate proximate the peripheral edge thereof. The neck block is adapted to be secured to a neck to the instrument, and the tail piece is adapted to secure two of the side plates together inside the instrument. Each side plate is fixed, such as with the adhesive, to the back plate, neck block and the tail piece. A metallic top plate is fixed to each side plate, the neck block and the tail piece. To the extent that the top plate and the bottom plate overhang or extend outwardly from the side plates, the overhanging portions are then removed with a router or the like. A saddle, a neck, and strings may then be attached in an appropriate order. An abraded region may be formed proximate the peripheral edge on an inside surface of the bottom plate, side plates, and top plate to increase the bonding of the adhesive.

15 Claims, 4 Drawing Sheets

KERFLESS AND BRACELESS METAL MUSICAL INSTRUMENTS AND METHOD

STATEMENT REGARDING FEDERALLY SPONSORED RESEARCH AND DEVELOPMENT

This application claims the benefit of U.S. Provisional Patent Application 61/218/689, filed on Jun. 19, 2009, and incorporated herein by reference.

FIELD OF THE INVENTION

This invention relates to musical instruments, and more particularly to a method of manufacturing metallic stringed instruments.

DISCUSSION OF RELATED ART

Traditional stringed instrument building methods use wood, which requires internal wooden bracing to prevent the thin wooden front and back panels from breaking or splitting. Such kerfing and bracing results in acoustic distortion and dampening inside the instrument, resulting in distorted tones being produced through the sound aperture of the instrument.

Therefore, there is a need for a method of making stringed instruments from stronger metallic materials that do not require kerfing and bracing inside the instrument. Such a needed method would allow stringed instruments to be manufactured relatively inexpensively and quickly, and would result in a light-weight instrument with an improved sound. The present invention accomplishes these objectives.

SUMMARY OF THE INVENTION

The present device is a method of manufacturing a musical instrument using relatively thin metal sheet materials. A metallic back plate is provided that has a peripheral edge. An abraded region may be formed proximate the peripheral edge on an inside surface thereon to increase the bonding of an "cold-weld" type adhesive thereto.

At least one metallic side plate with a peripheral edge is provided. Each side plate may have an abraded region formed proximate the peripheral edge on an inside surface thereof, and may be bent to conform to the shape of at least a portion of the peripheral edge or the abraded region of the back plate, as appropriate. A neck block and a tail piece may each be fixed to the inside surface of the back plate proximate the peripheral edge thereof. The neck block is adapted to be secured to a neck to the instrument, and the tail piece is adapted to secure two of the side plates together inside the instrument.

Each side plate is fixed, such as with the adhesive, to the neck block and the tail piece. Alternately, each side plate may be fixed to the neck block and the tail piece before the neck block and the tail piece are fixed to the back plate. Each side plate is positioned, and optionally temporarily adhered with its peripheral edge against the back plate, proximate to the abraded region thereof. As such each side plate may be properly positioned and then fixed to the back plate at the abraded regions, such as with the adhesive.

A metallic top plate is provided with a peripheral edge, an abraded region optionally being formed proximate the peripheral edge on an inside surface thereof. The top plate is fixed to each side plate, the neck block and the tail piece at the abraded regions thereof. A plurality of apertures may be formed through the top plate for fixing a saddle reinforcement bracket to the inside surface thereof. Further, a sound aperture may be formed through the top plate.

To the extent that the top plate and the bottom plate overhang or extend outwardly from the side plates, the overhanging portions are then removed with a router or the like. A saddle, a neck, and strings may then be attached in an appropriate order. The saddle may be screwed into a saddle reinforcement bracket through apertures of the top plate, or the saddle may be adhered to the top plate. In some embodiments, the neck may be adhered to one of the side plates and the top plate, instead of mechanically fastened with machine screws or the like to the neck block. In some embodiments, wherein the bottom plate, side plates, and top plate are well-cleaned or otherwise prepared for sufficient bonding with the adhesive, the abraded regions are unnecessary.

The present invention is a method of making stringed instruments from metallic sheet materials that are stronger than wood and do not require kerfing and bracing inside the instrument. The present method produces stringed instruments that can be manufactured relatively inexpensively and quickly, and results in a lighter-weight instrument with an improved sound. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
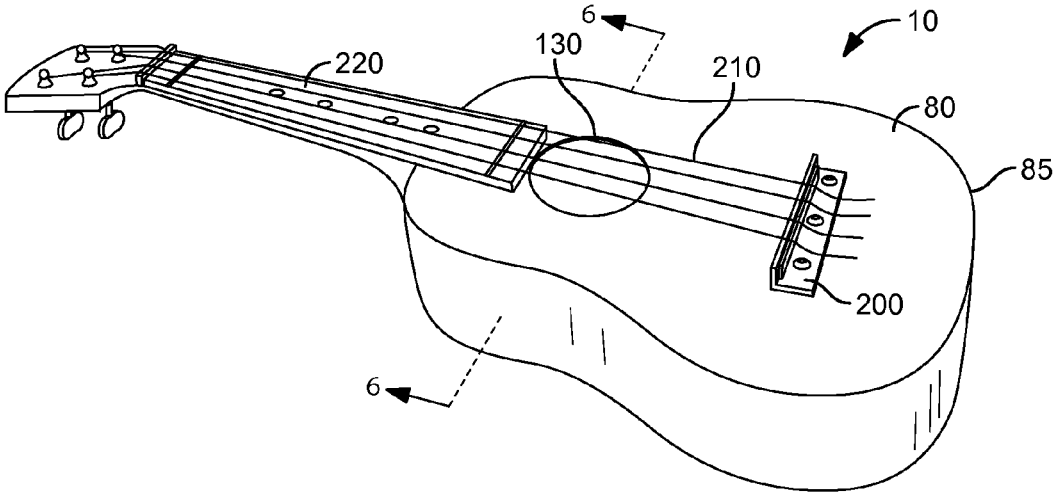
FIG. 1 is a perspective view of a musical instrument of the method.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

FIGS. 2-5 illustrate a method of manufacturing a musical instrument 10 (FIG. 1) using relatively thin metal sheet materials. A metallic back plate 20 is provided that has a peripheral edge 25. Such a metallic back plate 20 may be, for example, a flat sheet of 6061 Aluminum approximately 0.032" thick, copper, a malleable alloy, or the like. An abraded region 30 may be formed proximate the peripheral edge 25 on an inside surface 23 thereon (FIG. 2), such as with a tungsten carbide bit used in a Dremel-type rotary tool, a traditional metal file, or the like. The abraded region 30 may be approximately one-half inch wide, for example, and increases the bonding of adhesives thereto.

Figure 2:
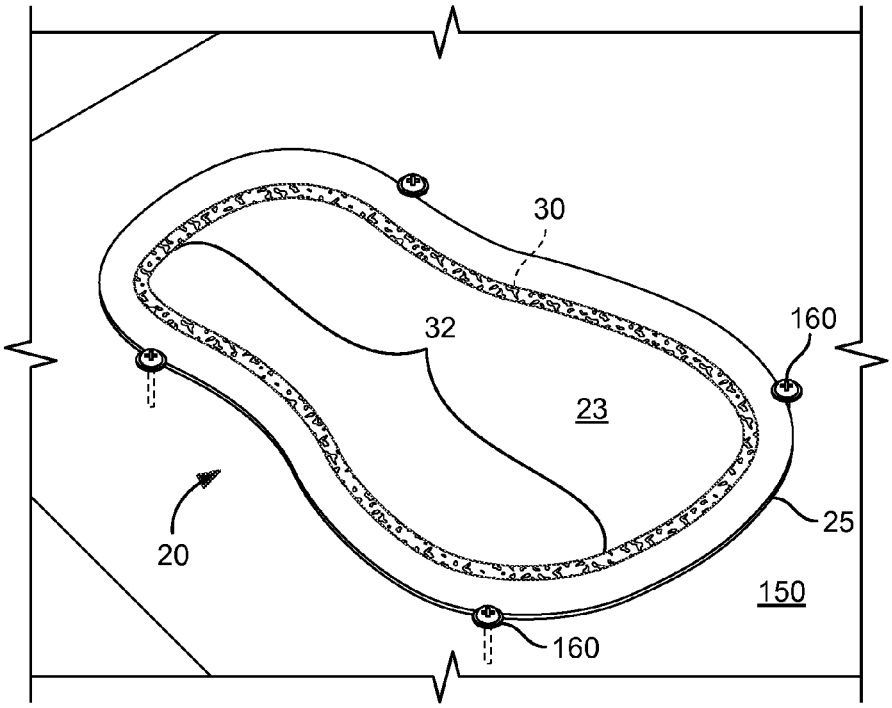
FIG. 2 is a perspective view of a back plate thereof fixed to a work surface.
Figure 3:
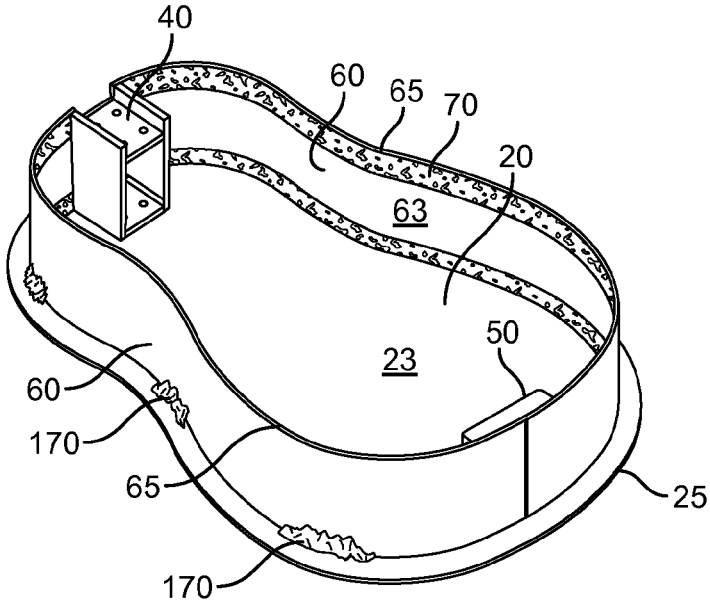
FIG. 3 is a perspective view of a pair of side plates fixed to the back plate thereof.

A work surface 150, such as a workbench or jig, may be used to facilitate the method, the back plate 20 being temporarily fixed thereto with a plurality of mechanical fasteners 160, such as screws with washers, at the peripheral edge 25 thereof (FIG. 2).

Figure 6:
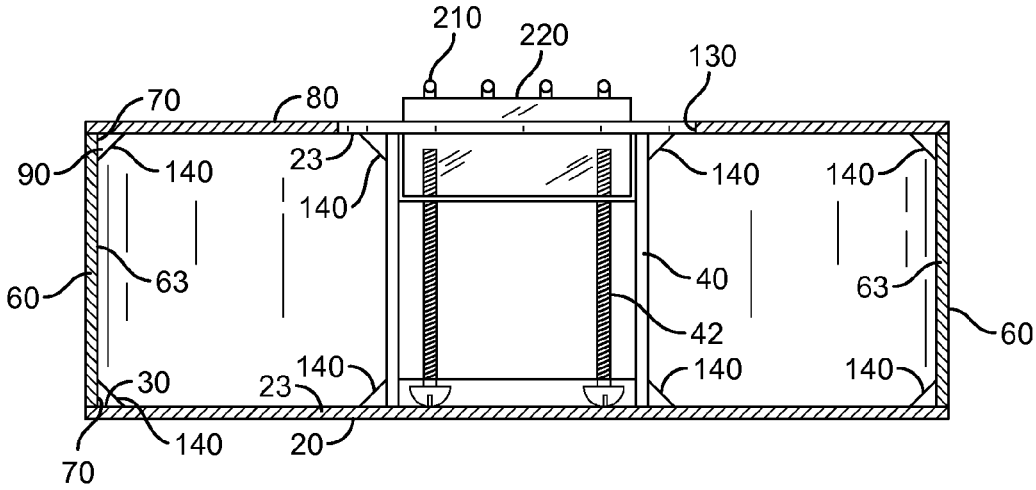
FIG. 6 is a cross-sectional view thereof, taken generally along lines 6—6 of FIG. 1.

A neck block 40 (FIGS. 3 and 6) and a tail piece 50 (FIG. 3) may each be fixed to the inside surface 23 of the back plate 20 proximate the peripheral edge 25 thereof. The neck block 40 and the tail piece 50 may be formed from the same metal material as the bottom plate 20, and adhered with a metal composite adhesive 140 (FIG. 6), such as the brand "Extreme Adhesive" by Extreme Adhesive, Inc. of Raymond, N.H., or JB Weld brand cold-weld adhesive, or the like. The neck block 40 and the tail piece 50 may be abraded in the regions thereof (not shown) that receive the adhesive 140, if desired. The neck block 40 is adapted to be secured to a neck 220 towards the end of the method, preferably with machine screws 42 or the like (FIG. 6). The tail piece 50 is adapted to secure two of the side plates 60 together inside the instrument 10.

Figure 7:
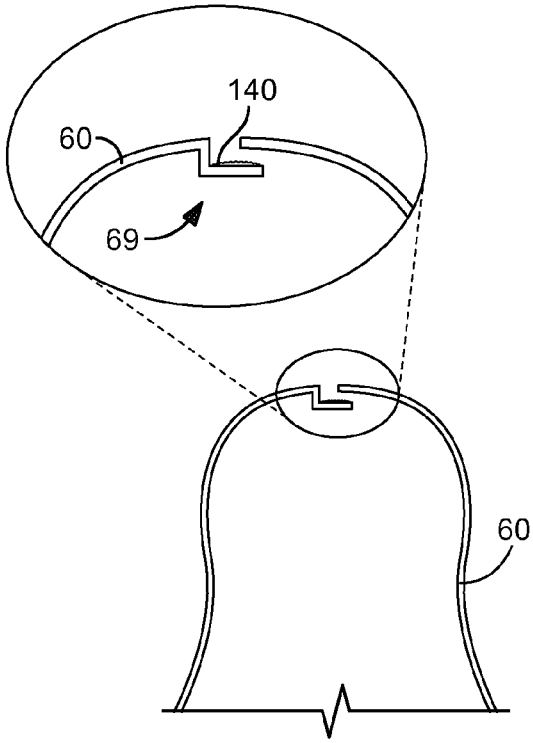
FIG. 7 is partial top-plan view of one embodiment of the invention.

Alternately, in an embodiment wherein a single side plate 60 is used (FIG. 7), ends 64 thereof may be formed with an overlap 69 for overlapping in a flush manner and still provide an adhesion region, which may be abraded or not as desired, and then mutually adhered. The tail piece 50 in such an embodiment is unnecessary. Likewise, even in some embodiment having more than one side plate 60, the ends 64 of each side plate 60 may be formed to overlap in a flush manner to provide the adhesion regions, such that each side plate 60 may be adhered or cold-welded to another of the side plates 60.

At least one metallic side plate 60 with a peripheral edge 65 is provided. Each side plate 60 may have an abraded region 70 formed proximate the peripheral edge 65 on an inside surface 63 thereof. The abraded region 70 may be approximately one-half inch wide, for example. Each side plate 60 may be bent (not shown) to conform to the shape of at least a portion 32 of the peripheral edge 25 or the abraded region 30 of the back plate 20, as appropriate. Each side plate 60 is fixed, such as with the adhesive 140, to the neck block 40 and the tail piece 50. Alternately, each side plate 60 may be fixed to the neck block 40 and the tail piece 50 before the neck block 40 and the tail piece 50 are fixed to the back plate 20.

Each side plate 60 is positioned, and optionally temporarily adhered, such as with hot glue 170 (FIG. 3), with its peripheral edge 65 against the back plate 20, proximate to the abraded region 70 thereof. As such each side plate 60 may be properly positioned and then fixed to the back plate 20 at the abraded regions 70, such as with the adhesive 140 (FIG. 6).

Figure 4:
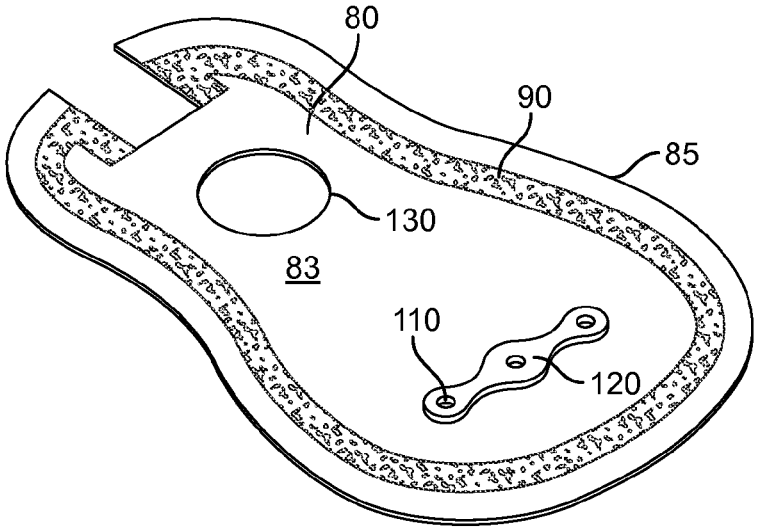
FIG. 4 is a perspective view of a top plate thereof, illustrating a sound aperture and a saddle reinforcement bracket.
Figure 5:
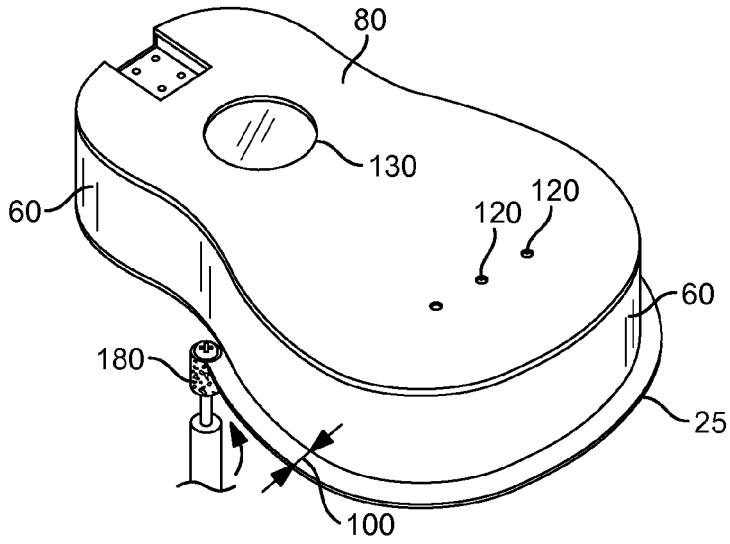
FIG. 5 is a perspective view of a router used to remove a portion of the back plate that extends outwardly past the side plates once the side plates are fastened thereto.

A metallic top plate 80 is provided with a peripheral edge 85, an optional abraded region 90 being formed proximate the peripheral edge 85 on an inside surface 83 thereof. The top plate 80 is fixed to each side plate 60, the neck block 40 and the tail piece 50 at the abraded regions 90,70 thereof. A plurality of apertures 110 may be formed through the top plate for fixing a saddle reinforcement bracket 120 to the inside surface 83 thereof. (FIG. 4). Further, a sound aperture 130 may be formed through the top plate 80 (FIGS. 1 and 4). Clearly the top plate 80 and the bottom plate 20 may be interchanged in the method of the present invention heretofore described, whereby the top plate 80 is formed and fixed to the neck block 40, tail piece 50 and side plates before the back plate 20, such as with the adhesive 140.

To the extent that the top plate 80 and the bottom plate 20 overhang or extend outwardly from the side plates 60, such as by approximately one-half inch, for example, the overhanging portions 100 are then removed with a router 180 (FIG. 5), or the like. The side plates 60, top plate 80, and bottom plate 20 may then be polished to provide a smooth finish thereon. Clearly the instrument 10 is removed from the work surface 150, if used, before the bottom plate 20 is trimmed with the router 180. A saddle 200, a neck 220, and strings 210 may then be attached in an appropriate order. The saddle 200 may be screwed into the saddle reinforcement bracket 120 through the apertures 110 of the top plate 80. In one embodiment, such apertures 110 are elongated ovals so that the saddle 200 may be selectively adjustably secured to the top plate 80. Alternately, the saddle 200 may be adhered to the top plate 80, rendering the saddle reinforcement bracket 120 and the apertures 110 superfluous. In some embodiments, the neck 220 may be adhered to one of the side plates 60 and the top plate 80, instead of mechanically fastened with machine screws 42 to the neck block 40, rendering the neck block 40 superfluous.

In some embodiments, wherein the bottom plate 20, side plates 60, and top plate 80 are well-cleaned or otherwise prepared for sufficient bonding with the adhesive 140, the abraded regions 30, 70, and 90 are unnecessary and not formed into the bottom plate 20, side plates 60, and top plate 80, respectively.

While a particular form of the invention has been illustrated and described, it will be apparent that various modifications can be made without departing from the spirit and scope of the invention. For example, the abraded regions 30, 70, 90 may be formed with the top plate 20, side plates 60, and top plate 90, respectively, or sometime thereafter, if at all. Accordingly, it is not intended that the invention be limited, except as by the appended claims.

The teachings provided herein can be applied to other systems, not necessarily the system described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

These and other changes can be made to the invention in light of the above Detailed Description. While the above description details certain embodiments of the invention and describes the best mode contemplated, no matter how detailed the above appears in text, the invention can be practiced in many ways. Details of the system may vary considerably in its implementation details, while still being encompassed by the invention disclosed herein.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description."While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A method of manufacturing a musical instrument, comprising the steps of:

a) providing a metallic back plate with a peripheral edge having an abraded region formed proximate the peripheral edge on an inside surface thereof;

b) fixing a neck block and a tail piece to the inside surface of the back plate proximate the peripheral edge thereof;

c) providing at least one metallic side plate with a peripheral edge having an abraded region formed proximate the peripheral edge on an inside surface thereof;

e) fixing each side plate to the neck block and tail piece;

f) positioning the peripheral edge of each side plate against the back plate proximate the peripheral edge of the back plate;

g) fixing each side plate to the back plate at the abraded regions;

h) providing a metallic top plate with a peripheral edge having an abraded region formed proximate the peripheral edge on an inside surface thereof;

i) fixing the top plate to each side plate, the neck block and the tail piece at the abraded regions; and j) removing any portions of the top and bottom back plates that extend outwardly past one of the at least one side plates.

2. The method of manufacturing a musical instrument of claim 1 further including the step of d) bending each side plate to conform to the shape of at least a portion of the abraded region of the back plate.

3. The method of manufacturing a musical instrument of claim 1 wherein after step h, h2) forming a plurality of apertures through the top plate for fixing a saddle reinforcement bracket to the inside surface thereof.

4. The method of manufacturing a musical instrument of claim 1 wherein steps c) and e) are performed before step b).

5. The method of manufacturing a musical instrument of claim 1 wherein after step f, f2) temporarily adhering the peripheral edge of each side plate against the back plate proximate the peripheral edge of the back plate.

6. A method of manufacturing a musical instrument on a work surface, comprising the steps of:

a) providing a metallic back plate with a peripheral edge and an inside surface;

b) temporarily fixing the back plate to the work surface with a plurality of mechanical fasteners at the peripheral edges thereof;

d) providing at least one metallic side plate with a peripheral edge and an inside surface;

g) positioning the peripheral edge of each side plate against the back plate proximate the peripheral edge of the back plate;

h) fixing the at least one side plate to the back plate, resulting in a portion of the back plate that extends outwardly past one of the at least one side plate;

i) providing a metallic top plate with a peripheral edge and an inside surface;

j) fixing the top plate to the at least one side plate to form a musical instrument, wherein said fixing the top plate results in a portion of the top plate that extends outwardly past one of the at least one side plate; and k) removing the instrument from the work surface.

7. The method of manufacturing a musical instrument of claim 6 further including the following steps:

a2) wherein after step a), forming an abraded region proximate the peripheral edge of the back plate on an inside surface thereof;

d2) wherein after step d), forming an abraded region proximate the peripheral edge of the at least one side plate on an inside surface thereof;

and wherein step h) further includes the limitation h) fixing each side plate to the back plate at the abraded regions;

and further including the step:

i2) wherein after step i), forming an abraded region proximate the peripheral edge of the top plate on an inside surface thereof; and wherein step j) further comprises: fixing the top plate to each side plate at the abraded regions.

8. The method of manufacturing a musical instrument of claim 7 further including the following steps:

c) wherein after step b) fixing a neck block and a tail piece to the inside surface of the back plate proximate the peripheral edge thereof;

f) wherein after step c) fixing each side plate to the neck block and tail piece;

i3) wherein after step i2) fixing the top plate to the neck block and the tail piece at the abraded regions.

9. The method of manufacturing a musical instrument of claim 8 further including after step k) the step:

l) removing any portions of the top and back plates that extend outwardly past one of the at least one side plates.

10. The method of manufacturing a musical instrument of claim 9 further including after step d2) the step of e) bending each side plate to conform to the shape of at least a portion of the abraded region of the back plate.

11. The method of manufacturing a musical instrument of claim 9 further including wherein after step i3), the step:

i4) forming a plurality of apertures through the top plate for fixing a saddle reinforcement bracket to the inside surface thereof.

12. The method of manufacturing a musical instrument of claim 9 further including wherein after step i3) the step:

i4) forming a sound aperture through the top plate.

13. The method of manufacturing a musical instrument of claim 9 wherein steps d), d2) and f) are performed before step c).

14. The method of manufacturing a musical instrument of claim 9 wherein said fixing steps are performed using an adhesive.

15. The method of manufacturing a musical instrument of claim 9 wherein after step g: g2) temporarily adhering the peripheral edge of each side plate against the back plate proximate the peripheral edge of the back plate.

* * * * *